US009341974B2

(12) United States Patent
Numata

(10) Patent No.: US 9,341,974 B2
(45) Date of Patent: May 17, 2016

(54) LIQUID APPLICATION DEVICE, IMAGE FORMING SYSTEM, AND METHOD OF CONTROLLING LIQUID APPLICATION DEVICE

(71) Applicant: Hironori Numata, Ibaraki (JP)

(72) Inventor: Hironori Numata, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/713,067

(22) Filed: May 15, 2015

(65) Prior Publication Data

US 2015/0338758 A1 Nov. 26, 2015

(30) Foreign Application Priority Data

May 21, 2014 (JP) ..... 2014-105575

(51) Int. Cl.

| | |
|---|---|
| ***G03G 15/10*** | (2006.01) |
| ***G03G 15/01*** | (2006.01) |
| ***B05C 1/08*** | (2006.01) |
| *G03G 15/11* | (2006.01) |

(52) U.S. Cl.

CPC ..... *G03G 15/01* (2013.01); *B05C 1/0834* (2013.01); *B05C 1/0873* (2013.01); *G03G 15/10* (2013.01); *G03G 15/101* (2013.01); *G03G 15/104* (2013.01); *G03G 15/11* (2013.01); *G03G 2215/017* (2013.01)

(58) Field of Classification Search

CPC ..... G03G 15/10
USPC ..... 399/237
See application file for complete search history.

(56) References Cited

U.S. PATENT DOCUMENTS

2011/0229179 A1* 9/2011 Yoshida ..... G03G 15/2025 399/67
2012/0020706 A1* 1/2012 Yoshida ..... G03G 15/1695 399/320
2014/0253652 A1* 9/2014 Ohba ..... B41J 11/0015 347/101

FOREIGN PATENT DOCUMENTS

| | | | |
|---|---|---|---|
| JP | 11-249444 | 9/1999 | |
| JP | 2008-260307 | * 10/2008 | ..... B41J 2/01 |
| JP | 2010-158602 | * 7/2010 | ..... B05C 1/02 |
| JP | 2011-062831 | 3/2011 | |

* cited by examiner

*Primary Examiner* — Clayton E Laballe
*Assistant Examiner* — Kevin Butler
(74) *Attorney, Agent, or Firm* — Oblon, McClelland, Maier & Neustadt, L.L.P.

(57) ABSTRACT

A liquid application device includes an application roller, a container, a supply roller, a transfer unit, and a controller. The application roller applies a liquid to a target. The container stores the liquid. The supply roller rotates with the supply roller immersed in the container and supplies the liquid to the application roller. The transfer unit contacts the target with the application roller and causes the application roller to apply the liquid to the target. The controller controls an operation of the liquid application device. In a state in which the transfer unit does not contact the target with the application roller, the controller controls the supply roller to rotate and stop at a position different from a pre-rotation position of the supply roller.

7 Claims, 5 Drawing Sheets

LIQUID APPLICATION DEVICE, IMAGE FORMING SYSTEM, AND METHOD OF CONTROLLING LIQUID APPLICATION DEVICE

CROSS-REFERENCE TO RELATED APPLICATIONS

This patent application is based on and claims priority pursuant to 35 U.S.C. §119(a) to Japanese Patent Application No. 2014-105575, filed on May 21, 2014, in the Japan Patent Office, the entire disclosure of which is hereby incorporated by reference herein.

BACKGROUND

1. Technical Field

Aspects of the present disclosure relate to a liquid application device, an image forming system, and a method of controlling the liquid application device and more particularly, to control for supply of a liquid to be applied.

2. Description of the Related Art

Recently, with digitization of information promoted, image processing apparatuses such as a printer and a facsimile machine used for output of digitized information and a scanner used for digitization of documents have become indispensable apparatuses. Such image processing apparatuses are often configured as a multifunction peripheral that includes an image pick-up function, an image forming function, and a communication function and can be used as a printer, a facsimile machine, a scanner, and a copier.

For such image processing apparatuses, for example, in an image forming apparatus used for output of digitized documents, a technology is generally known for applying a treatment liquid to condense a color material of ink by pretreatment to prevent states affecting printing qualities, such as bleeding, density fluctuation, color tone fluctuation, and print-through and improve printing qualities.

SUMMARY

In an aspect of the present disclosure, there is provided a liquid application device including an application roller, a container, a supply roller, a transfer unit, and a controller. The application roller applies a liquid to a target. The container stores the liquid. The supply roller rotates with the supply roller immersed in the container and supplies the liquid to the application roller. The transfer unit contacts the target with the application roller and causes the application roller to apply the liquid to the target. The controller controls an operation of the liquid application device. In a state in which the transfer unit does not contact the target with the application roller, the controller controls the supply roller to rotate and stop at a position different from a pre-rotation position of the supply roller.

In an aspect of the present disclosure, there is provided an image forming system including an image forming apparatus, and a liquid application device. The image forming apparatus ejects a color material to a target to form an image on the target. The liquid application device applies a liquid to the target before the image forming apparatus forms the image on the target. The liquid application device includes an application roller, a container, a supply roller, a transfer unit, and a controller. The application roller applies the liquid to the target. The container stores the liquid. The supply roller rotates with the supply roller immersed in the container and supplies the liquid to the application roller. The transfer unit contacts the target with the application roller and causes the application roller to apply the liquid to the target. The controller controls an operation of the liquid application device. In a state in which the transfer unit does not contact the target with the application roller, the controller controls the supply roller to rotate and stop at a position different from a pre-rotation position of the supply roller.

In an aspect of the present disclosure, there is provided a method of controlling a liquid application device that includes an application roller to apply a liquid to a target. The method includes rotating a supply roller immersed in a container storing the liquid, in a state in which the application roller is not in contact with the target; and rotating and stopping the supply roller at a position different from a pre-rotation position.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
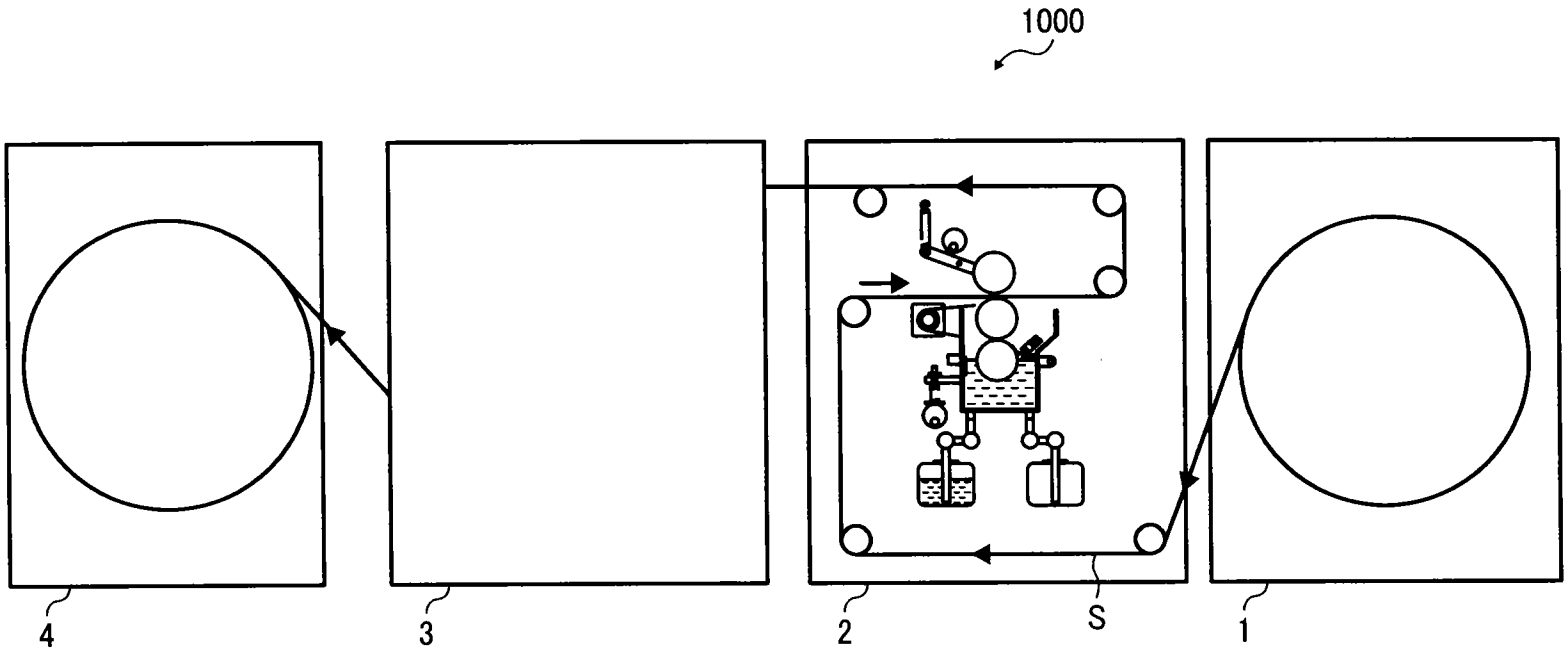
FIG. 1 is a diagram of an entire configuration of an image forming system including a treatment-liquid application device according to an embodiment of the present disclosure.

The accompanying drawings are intended to depict embodiments of the present disclosure a ad should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

For example, in an image forming apparatus, in a specific time after a printing process for attaching a developer liquid to a belt-type photoconductor by a developing roller, a cleaning roller is made to contact a squeeze roller and the surplus developer liquid attached to the belt-type photoconductor is removed by the squeeze roller.

In such a configuration, when the surplus developer liquid attached to the belt-type photoconductor in the developer liquid attached to the belt-type photoconductor by the developing roller is removed, the cleaning roller is made to contact the squeeze roller. For this reason, the developer liquid accumulated in a nipping portion between the cleaning roller and the squeeze roller may not be fully removed. In addition, if the developer liquid accumulated in the nipping portion between the cleaning roller and the squeeze roller is left for a long time, volatile components are evaporated and corrosion components of the developer liquid increase in concentration. As a result, liquid accumulation may occur.

Such liquid accumulation occurs often when the liquid is concentrated on a certain place in a circumferential direction of a surface of the squeeze roller even in a state in which the cleaning roller is separated from the squeeze roller. If corrosion occurs at a position of the liquid accumulation and a dent is formed in the surface of the squeeze roller, uneven application of the developer liquid for the belt-type photoconductor occur due to the dent and a glossiness difference and a density difference of an image may occur. For this reason, the product life of the squeeze roller greatly decreases. Such a problem may occur in a liquid application device supplying a liquid with a rotating roller and applying the liquid as well as an application mechanism of a treatment liquid in an image forming apparatus.

Hereinafter, embodiments of the present disclosure will be described in detail with reference to the drawings.

In the following embodiment, a liquid application device is described that applies a liquid to a sheet surface before an inkjet-type image forming apparatus using a roll sheet forms and outputs an image on the sheet in an image forming system.

FIG. 1 is a diagram of an entire configuration of an image forming system 1000 according to an embodiment of this disclosure. As illustrated in FIG. 1, the image forming system 1000 according to this embodiment includes a sheet feeding device 1 that feeds a long roll sheet S wound in a roll shape and serves as a pretreatment device, a treatment-liquid application device 2 that applies a liquid to a surface of the roll sheet S fed from the sheet feeding device 1, an inkjet printer body 3 that ejects a color material to the roll sheet S to which the liquid has been applied by the treatment-liquid application device 2 and forms an image, and a post-treatment device 4 that winds the sheet on which the image has been formed. Here, a feed speed of the roll sheet S of the image forming system 1000, that is, an application speed can be set to any speed in the range from 15 m/min to 150 m/min, for example. In addition, in this embodiment, the treatment-liquid application device 2 serves as the liquid application device.

In the configuration illustrated in FIG. 1, a point of this embodiment is at a configuration of rotation control of a roller to supply the liquid applied to the surface of the roll sheet S in the treatment-liquid application device 2. In the treatment-liquid application device 2, a treatment liquid L to be a pre-applying liquid such as an inhibitor having a function of condensing ink droplets applied to the surface of the roller sheet S is applied to the roll sheet S. The treatment liquid L is applied to the entire surface of the roll sheet S to condense a color material of ink ejected to the surface of the roll sheet S in the inkjet printer body 3.

Thereby, bleeding, density fluctuation, and color tone fluctuation of the ink ejected to the roll sheet S are prevented and a printing quality is improved. In this embodiment, the case in which the treatment liquid L is applied to the roll sheet S by the treatment-liquid application device 2 is described as an example. However, the material is not limited to the sheet and may be a recording medium such as a film and a plastic sheet.

Figure 2:
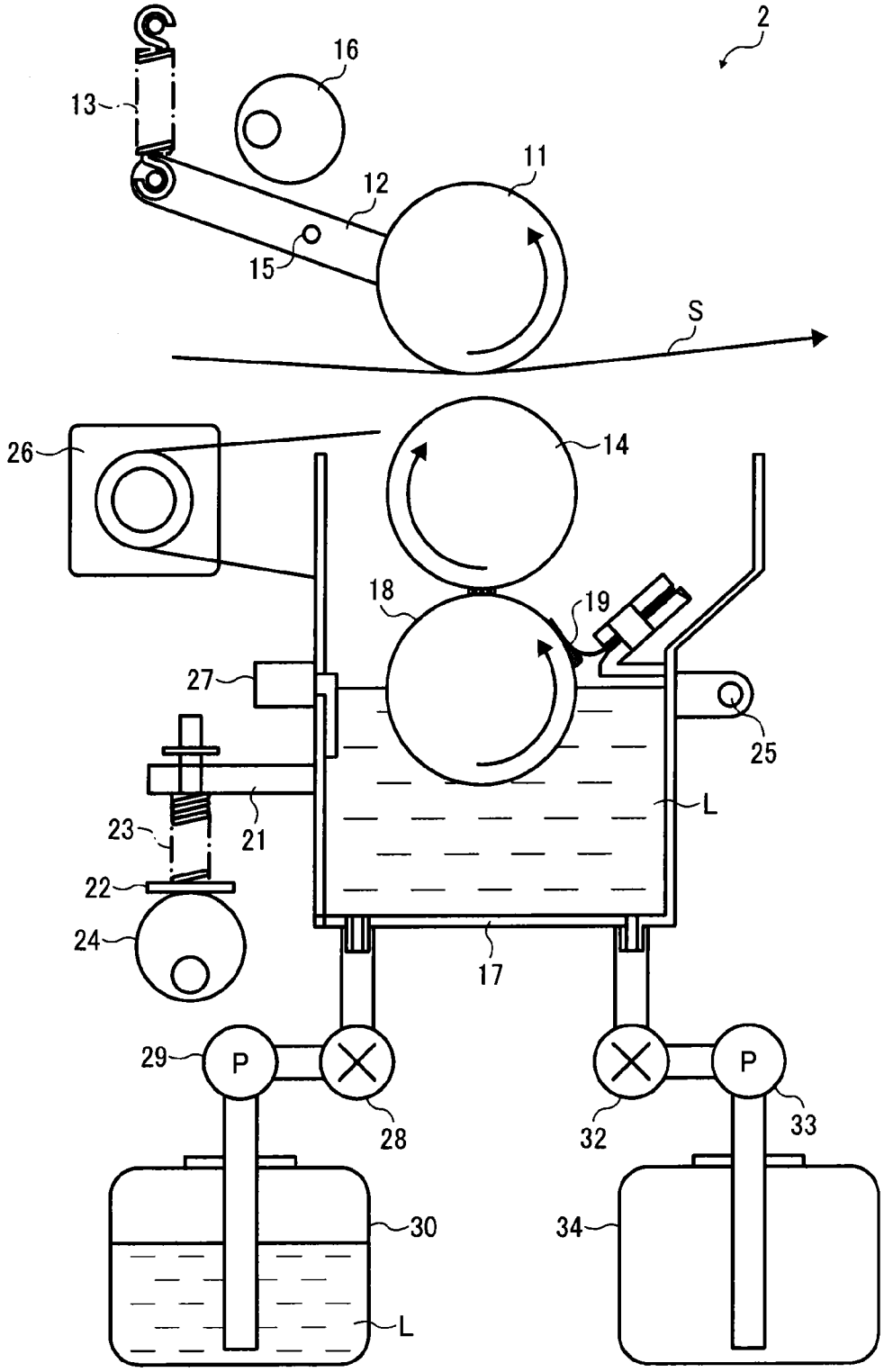
FIG. 2 is a diagram of a configuration of a treatment-liquid application device according too an embodiment of the present disclosure.

Next, a configuration of the treatment-liquid application device 2 according to this embodiment will be described with reference to FIG. 2. As illustrated in FIG. 2, in the treatment-liquid application device 2 according to this embodiment, a cylindrical transfer roller 11 is rotatably supported on one end of an arm 12 for the transfer roller. A tension spring 13 is connected to the other end of the arm 12 for the transfer roller and the transfer roller 11 is biased downward by tension of the tension spring 13. An application roller 14 to apply the treatment liquid L to the surface of the roll sheet S is rotatably disposed below the transfer roller 11. That is, the application roller 14 applies the treatment liquid L to be a liquid to the roll sheet S to be a target. The transfer roller 11 is a transfer unit that contacts the roll sheet S with the application roller 14 and applies the treatment liquid L applied to the application roller 14 to the surface of the roll sheet S.

A swing fulcrum shaft 15 of the arm 12 for the transfer roller is provided at an intermediate position of the arm 12 for the transfer roller. An eccentric cam 16 is disposed above a portion of the arm 12 between the swing fulcrum shaft 15 and a connector connecting the tension spring 13. By rotation of the eccentric cam 16, the transfer roller 11 can be separated from the application roller 14 against the tension of the tension spring 13.

The transfer roller 11, the arm 12 for the transfer roller, the tension spring 13, and the eccentric cam 16 are arranged above an opening of a supply chamber 17 serving as a container that stores the treatment liquid L.

Below the application roller 14, a squeeze roller 18 to turn the treatment liquid L into a thin layer and transfer the treatment liquid L to the application roller 14 is arranged parallel to an axial direction of the application roller 14. The squeeze roller 18 includes stainless steel, preferably, austenite (for example, SUS303) as a base material. In the squeeze roller 18, in addition to SUS303, SUS304 and SUS316 may be used as the base material. A surface of the squeeze roller 18 has a flat shape in which arithmetic average roughness (Ra) is less than 6.4 μm (Ra<6.4 μm).

The application roller 14 and the squeeze roller 18 are stored in the supply chamber 17. The squeeze roller 18 is supported by the swingable supply chamber 17. The application roller 14 is supported at a predetermined position by other support. That is, the squeeze roller 18 is a supply roller that supplies the treatment liquid L to the application roller 14. In addition, a blade 19 is disposed facing a surface of the squeeze roller 18 to prevent scattering of the treatment liquid during rotation of the squeeze roller 18.

At one side of the supply chamber 17 that is a side at which the arm 12 for the transfer roller is disposed in FIG. 2, an arm 21 for the squeeze roller projects in a horizontal direction. The arm 21 for the squeeze roller is biased downward by a compression spring 23 via a pin 22. An eccentric cam 24 is disposed below the pin 22. At the other side of the supply chamber 17, a swing fulcrum shaft 25 of the supply chamber 17 is disposed.

The treatment liquid L is accumulated in the supply chamber 17 and a liquid level of the treatment liquid L is maintained constant in a state in which the treatment liquid L is supplied to the supply chamber 17. The squeeze roller 18 is disposed at a position at which the squeeze roller 18 is partially immersed in the treatment liquid L. When a motor 26 serving as a driving source is driven to rotate the application roller 14, the squeeze roller 18 rotates with the rotation of the application roller 14 and feeds the treatment liquid L to a nipping portion to be a space between the application roller 14 and the squeeze roller 18, by viscosity of the treatment liquid L.

The application roller 14 is pressed against the squeeze roller 18 to contact the squeeze roller 18 with a predetermined pressure. Pressing the application roller 14 against the squeeze roller 18 allows measurement of a liquid amount of the treatment liquid L having passed through the nipping portion between the application roller 14 and the squeeze roller 18 and the measured treatment liquid L is maintained on the surface.

The treatment liquid L passes through the nipping portion between the application roller 14 and the squeeze roller 18 and forms a thin layer of the treatment liquid L uniformized on the surface of the application roller 14. The eccentric cam 16 is rotated to move the transfer roller 11 downward, and the roll sheet S is pushed to the application roller 14 by the transfer roller 11, so that the thin layer of the treatment liquid L uniformized and formed on the surface of the transfer roller 11 is transferred to the surface of the roll sheet S and is applied to the surface. A material of the treatment liquid L is appropriately set in consideration of a type of ink used in an inkjet printer or a material of the roll sheet S.

The liquid level of the treatment liquid L in the supply chamber 17 is monitored with a liquid level sensor 27 attached to a lateral surface of the supply chamber 17. When the liquid level of the treatment liquid L in the supply chamber 17 is lower than a predetermined position during detection of the liquid level with the liquid level sensor 27, a supply valve 28 is opened to drive a supply pump 29, so that the treatment liquid L in a treatment liquid tank 30 having a high sealing degree is fed to the supply chamber 17. In addition, when the liquid level of the treatment liquid L in the supply chamber 17 is at the predetermined position during detection of the liquid level with the liquid level sensor 27, the supply valve 28 is closed to stop the supply pump 29, so that a liquid level position of the treatment liquid L in the supply chamber 27 is maintained constant.

The supply valve 28 is a liquid feed-and-discharge unit that supplies the treatment liquid L to the supply chamber 17 by driving of the supply pump 29 in an open-controlled state, evacuates the treatment liquid L in the supply chamber 17 to the treatment liquid tank 30 by a liquid level difference of the treatment liquid L by open control in a state in which the treatment liquid L is supplied to the supply chamber 17, and stores the treatment liquid. That is, from the viewpoint of preventing deterioration of properties due to a viscosity increase of the treatment liquid L, the supply valve 28 has a function of being open-controlled, returning the treatment liquid L in the supply chamber 17 to the treatment liquid tank 30 by the liquid level difference, and storing the treatment liquid, after an application operation of the treatment liquid L for the roll sheet S by the treatment-liquid application device 2 is executed.

In addition, a drain valve 32, a drain pump 33, and a waste-liquid tank 34 are provided to drain the used treatment liquid L in consideration of the deterioration of the properties due to the viscosity increase of the treatment liquid L. The drain valve 32 is opened and the drain pump 33 is driven, so that the deteriorated treatment liquid L in the supply chamber 17 is drained to the waste-liquid tank 34.

Figure 3:
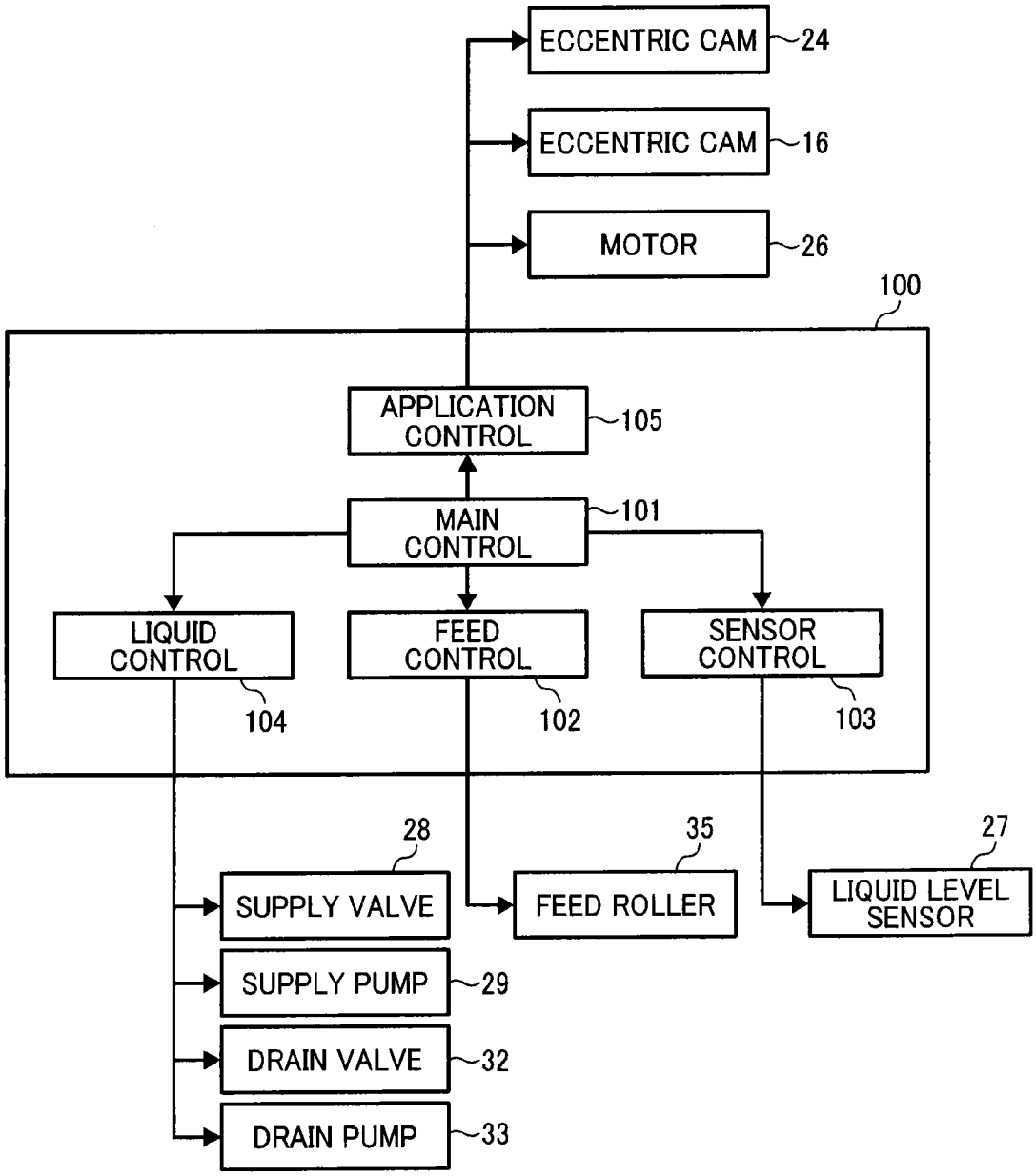
FIG. 3 is a block diagram of a control configuration of a treatment-liquid application device according to an embodiment of the present disclosure.

Next, a control configuration of the treatment-liquid application device 2 according to this embodiment will be described with reference to FIG. 3. FIG. 3 is a block diagram of the control configuration of the treatment-liquid application device 2 according to the embodiment of the present disclosure. As illustrated in FIG. 3, the treatment-liquid application device 2 according to this embodiment is configured such that a controller 100 to be a control unit controls configurations of individual units of the device.

The controller 100 is configured by a combination of software and hardware. For example, the controller 100 is configured by a software control configured by an operation of a central processing unit (CPU) according to a control program such as firmware stored in a read only memory (ROM), a nonvolatile memory, a nonvolatile-random access memory (NV-RAM), and a nonvolatile recording medium such as an optical disk and hardware such as an integrated circuit.

As illustrated in FIG. 3, the controller 100 includes a main control 101, a feed control 102, a sensor control 103, a liquid control 104, and an application control 105. The main control 101 controls the individual units included in the controller 100 and commands to the individual units of the controller 100. According to control of the main control 101, the feed control 102 controls rotation of the feed roller 35 to feed the roller sheet S and feeds the roll sheet S.

The sensor control 103 acquires a detection signal output by the liquid level sensor 27 and inputs the detection signal to the main control 101. According to control of the main control 101, the liquid control 104 controls opening/closing of the supply valve 28 and driving of the supply pump 29, controls replenishment of the treatment liquid L for the supply chamber 17, controls opening/closing of the drain valve 32 and driving of the drain pump 33, and controls the drain of the treatment liquid L from the supply chamber 17.

According to control of the main control 101, the application control 105 controls rotation of the motor 26, controls rotation of the application roller 14 and the squeeze roller 18, and controls replenishment of the treatment liquid L from the squeeze roller 18 to the application roller 14 and application of the treatment liquid L by the application roller 14. In addition, the application control 105 controls rotational positions of the eccentric cams 16 and 24 and controls a vertical movement of the transfer roller and a vertical movement of the squeeze roller 18, that is, a press of the squeeze roller 18 against the application roller.

In such a configuration, a point of this embodiment is at rotation control of the squeeze roller 18 by the application control 105. First, a problem to be resolved in this embodiment will be described in detail.

When an application operation for applying the treatment liquid L to the roll sheet S is executed by the treatment-liquid application device 2 according to this embodiment, after an output of the liquid level sensor 27 is monitored by the main control 101 through the sensor control 103, the treatment liquid L of a predetermined amount is refilled into the supply chamber 17, the squeeze roller 18 is pressed against the application roller 14 and the transfer roller 11 is pressed against the application roller 14 via the roll sheet S, the application roller 14 and the squeeze roller 18 are rotated by driving the motor 26.

When the application operation is executed, a flow amount of the treatment liquid L supplied to the application roller 14 is measured by the pressing of the squeeze roller 18 against the application roller 14 and liquid accumulation of the treatment liquid L of a surplus supply amount is formed on an upstream side of the nipping portion of the application roller 14 and the squeeze roller 18 by the measurement.

Meanwhile, when the application operation stops, driving of the motor 26 stops, each of the transfer roller 11 and the squeeze roller 18 is separated from the application roller 14, and a mode enters a standby state. That is, when the application operation stops, the treatment liquid L of the surplus flow amount is accumulated, that is, the liquid accumulation is formed between the application roller 14 and the squeeze roller 18. Likewise, the liquid accumulation of the treatment liquid L is formed between the blade 19 and the squeeze roller 18.

If a state in which the liquid accumulation of the treatment liquid L is formed between the application roller 14 and the squeeze roller 18 and between the blade 19 and the squeeze roller 18 is maintained, volatile components of the treatment liquid L of a liquid accumulation portion are evaporated and components to corrode a metal of the treatment liquid L increase in concentration and are condensed. As a corrosion form of the metal, there is the phenomenon called crevice corrosion. In a state in which the liquid is accumulated in a crevice, a corrosion speed increases remarkably as compared with normal attachment of the liquid.

Specifically, metal corrosion occurs often at a position where the liquid accumulation of the treatment liquid L is formed along a longitudinal direction in the space of the squeeze roller 18 and the application roller 14, that is, a phase. The liquid accumulation of the treatment liquid L is concentrated and formed often on one place in a circumferential direction of the surface of the squeeze roller 18. If the formed liquid accumulation of the treatment liquid L is left, the metal corrosion causes a dent in the surface of the squeeze roller 18. In addition, uneven application of the treatment liquid L for the application roller 14 occurs due to the dent and a glossiness difference and an image density difference of an image may occur. For this reason, the life of the squeeze roller 18 greatly decreases. This is the problem to be resolved in this embodiment.

A point of the treatment-liquid application device 2 according to this embodiment is at control to execute intermittent rotation driving of the squeeze roller 18 when the application operation is not executed, from the viewpoint of preventing the corrosion of the squeeze roller 18. Hereinafter, control of the treatment-liquid application device 2 according to this embodiment will be described.

Figure 4A:
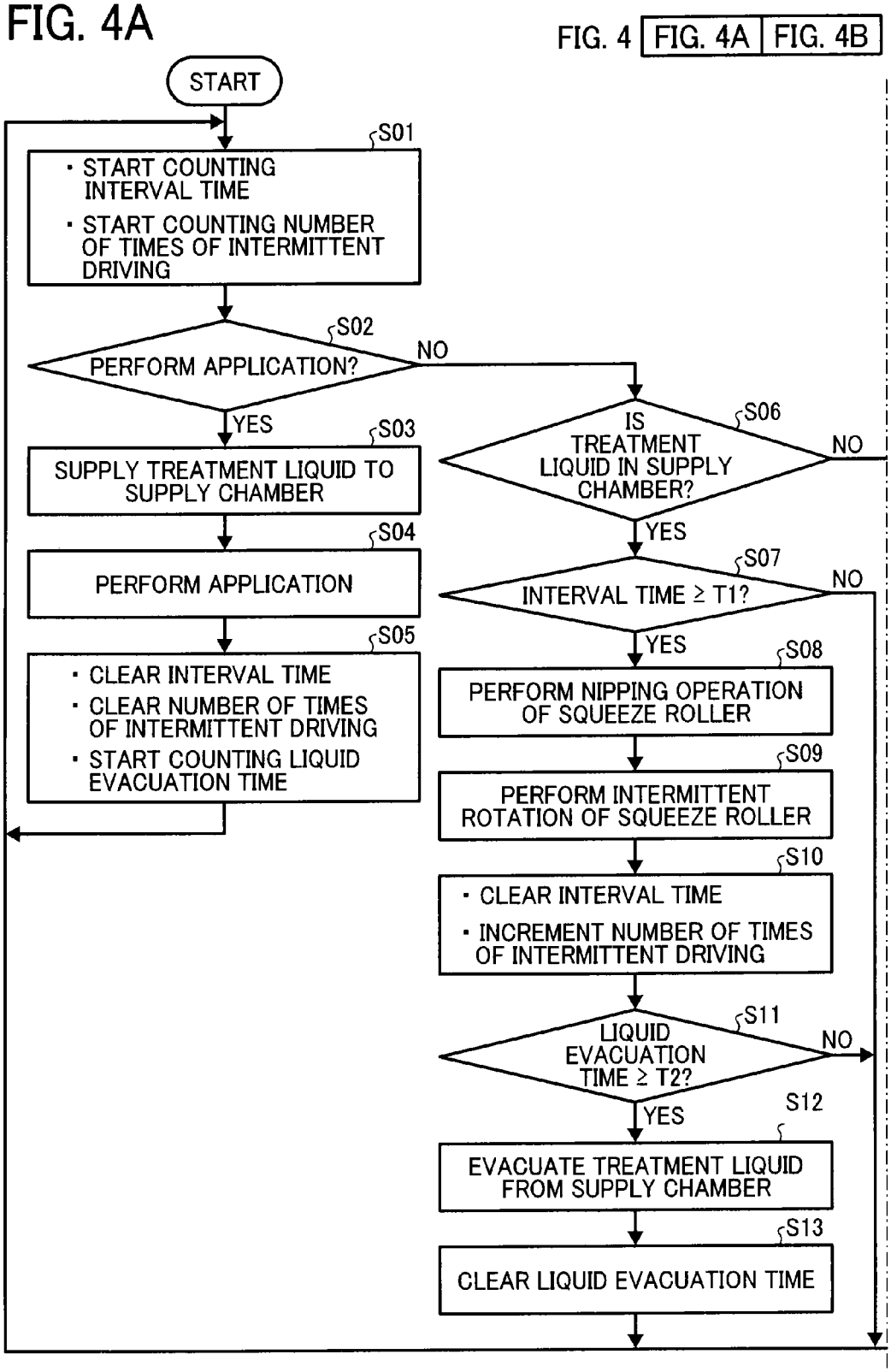
FIGS. 4A and 4B is a flowchart of a control operation of a treatment-liquid application device according to an embodiment of the present disclosure.
Figure 4B:
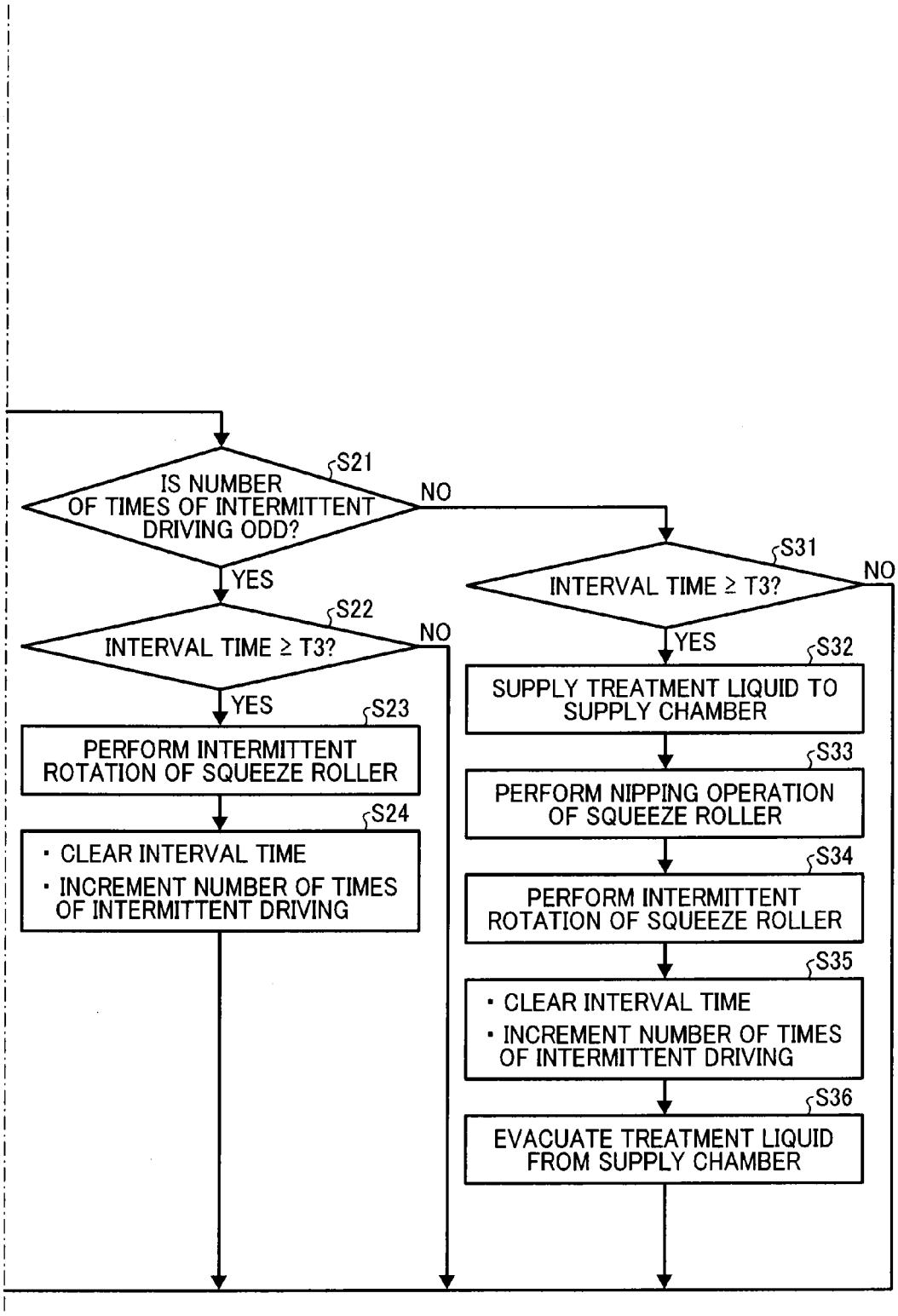

FIGS. 4A and 4B is a flowchart of a control operation of the treatment-liquid application device 2 according to this embodiment. As illustrated in FIG. 4A, when a power supply of the treatment-liquid application device 2 is turned on, the main control 101 starts counting an interval time after execution of the intermittent rotation driving of the squeeze roller 18, and starts counting of the number of times of intermittent driving of the squeeze roller 18 (S01). When the main control 101 issues an application operation execution command and the treatment-liquid application device 2 performs the application operation (S02/YES), the liquid control 104 controls opening/closing of the supply valve 28, drives the supply pump 29 to supply the treatment liquid L to the supply chamber 17 (S03). Then, the application control 105 drives the motor 26 to rotate the eccentric cam 16 while rotating the squeeze roller 18 and the application roller 14, moves the transfer roller 11 downward, contact the surface of the roll sheet S with the application roller 14, and performs the application operation for applying the treatment liquid L having been applied to the surface of the application roller 14 to the surface of the roll sheet S (S04).

With the execution of the application operation in S04, the interval time and the number of times of intermittent driving for which counting has started at S01 are cleared and counting of a liquid evacuation time necessary for returning the treatment liquid L supplied to the supply chamber 17 to the treatment liquid tank 30 starts (S05). Then, the main control 101 repeats the process starting from S01.

Meanwhile, when the main control 101 does not issue the application operation execution command and the treatment-liquid application device 2 does not perform the application operation (S02/NO), the main control 101 determines whether the treatment liquid L exists in the supply chamber 17, using the liquid level sensor 27 (S06). When the treatment liquid L is supplied to the supply chamber 17 (S06/YES), the main control 101 determines whether the interval time for which counting has started at S01 is a threshold time T1 or more (S07). When the interval time is the threshold time T1 or more (S07/YES), the main control 101 rotates the eccentric cam 24 with a driving source and causes the surface of the squeeze roller 18 to contact the surface of the application roller 14 (S08). In this state, the main control 101 drives the motor 26 via the application control 105 and executes the intermittent rotation driving of the squeeze roller 18 (S09).

At this time, T1 is a time (T2>T1) shorter than a time T2 described below, for example, 0.75 hour, and the intermittent rotation driving of the squeeze roller 18 is executed before the treatment liquid L supplied to the supply chamber 17 is evacuated to and stored in the treatment liquid tank 30. When the interval time is less than T1 (S07/NO), the main control 101 repeats the process starting from S01. That is, S07/NO corresponds to when the application operation at S02 is executed before a time reaches T1 to execute the intermittent rotation driving of the squeeze roller 18. In this case, the possibility of corrosion of the squeeze roller 18 is low and necessity of the intermittent rotation driving of the squeeze roller 18 is low.

The intermittent rotation driving of the squeeze roller 18 at S09 is executed under control of a rotation time of the motor 26 with the application control 105. In one intermittent rotation driving, the squeeze roller 18 is rotated in a circumferential direction, for example, by 115° so that a position of the squeeze roller 18 in a circumferential direction thereof, that is, a phase when the squeeze roller 18 stops is different from a pre-rotation position of the squeeze roller 18, that is, a phase before the intermittent rotation driving of the squeeze roller 18 starts. When the intermittent rotation driving at S09 is executed, the application control 105 controls a rotation speed of the motor 26 to rotate the squeeze roller 18 at a circumferential speed equal to or lower than a minimum application speed when the squeeze roller 18 is rotated in the application operation, for example, 15 m/min.

With the intermittent rotation driving of the squeeze roller 18 at S09, the interval time for which counting has started at S01 is cleared and the number of times of intermittent driving is incremented, that is, counted by one (S10).

Then, the main control 101 determines whether the liquid evacuation time for which counting has started at S05 is the threshold time T2 or more (S11). When the liquid evacuation time is T2 or more (S11/YES), the main control 101 controls opening/closing of the supply valve 28, evacuates the treatment liquid L in the supply chamber 17 to the treatment liquid tank 30 by the liquid level difference, and stores the treatment liquid L in the treatment liquid tank 30 (S12). At this time, T2 is, for example, one hour. Then, the main control 101 clears the liquid evacuation time for which counting has started by S05 (S13). Then, the main control 101 repeats the process starting from S01.

When the treatment liquid L is not supplied to the supply chamber 17 (S06/NO), the main control 101 determines whether the number of times of intermittent driving for which counting has started at S01 is an odd number (1, 3, 5, . . . ) or an even number (2, 4, 6, . . . ) (S21). When the number of times of intermittent driving is an odd number (S21/YES), the main control 101 determines whether the interval time for which counting has started at S01 is a threshold time T3 is more (S22). When the interval time is T3 or more (S22/YES), the main control 101 drives the motor 26 and executes the intermittent rotation driving of the squeeze roller 18 (S23).

The intermittent rotation driving of the squeeze roller 18 at S23 is executed under the control of the rotation time of the motor 26 with the application control 105, the squeeze roller 18 is rotated in a circumferential direction, for example, by 115° in one intermittent rotation driving so that a position of the squeeze roller 18 in the circumferential direction, that is, a phase when the squeeze roller 18 stops is different from a pre-rotation position of the squeeze roller 18, i.e., a phase before the intermittent rotation driving of the squeeze roller 18 starts. At S23, rotation driving of the squeeze roller 18 is executed such that the rotation speed becomes a circumferential speed equal to or lower than the minimum application speed when the squeeze roller 18 is rotated at the time of the application operation, for example, 15 m/min.

Here, in a state in which the treatment liquid L is not supplied to the supply chamber 17, T3 is set to, for example, two hours to increase an interval of the intermittent rotation driving of the squeeze roller 18, suppress the temperature of the treatment liquid L and the viscosity of the treatment liquid L from being increased due to friction caused by the intermittent rotation driving of the squeeze roller 18, and decrease the number of times of supplying the treatment liquid L to the supply chamber 17.

That is, at S23, the intermittent rotation driving of the squeeze roller 18 is executed in a standby state in which the squeeze roller 18 is not in contact with the application roller 14 and the transfer roller 11 does not contact the roll sheet S with the application roller 14, that is, an evacuation state. With the intermittent rotation driving of the squeeze roller 18 at S23, the interval time for which counting has started at S01 is cleared and the number of times of intermittent driving for which counting has started at S01 is counted (S24). Then, the main control 101 repeats the process starting from S01.

Meanwhile, when the number of times of intermittent driving is the even number (S21/NO), the main control 101 determines whether the interval time for which counting has started at S01 is the threshold time T3 or more (S31). When the interval time is T3 or more (S31/YES), the main control 101 controls opening/closing of the supply valve 28 and drives the supply pump 29 to supply the treatment liquid L to the supply chamber 17 (S32). Then, the main control 101 rotates the eccentric cam 24 with a driving source to cause the squeeze roller 18 to nip the application roller 14 (S33). In this state, the main control 101 drives the motor 26 and executes the intermittent rotation driving of the squeeze roller 18 (S34).

The intermittent rotation driving in S34 is executed under the control of the rotation time of the motor 26 with the application control 105, and the squeeze roller 18 is rotated in a circumferential direction, for example, by 115° in one intermittent rotation driving so that a position of the squeeze roller 18 in the circumferential direction, that is, a phase when the squeeze roller 18 stops is different from a pre-rotation position, that is, a phase before the intermittent rotation driving of the squeeze roller 18 starts. At S34, the rotation driving of the squeeze roller 18 is executed such that the rotation speed becomes a circumferential speed equal to or lower than the minimum application speed when the squeeze roller 18 is rotated at the time of the application operation, for example, 15 m/min.

With the intermittent rotation driving of the squeeze roller 18 at S34, the interval time for which counting has started at S01 is cleared and the number of times of intermittent driving is counted (S35). Then, the main control 101 controls opening/closing of the supply valve 28, evacuates the treatment liquid L in the supply chamber 17 to the treatment liquid tank 30 by the liquid level difference, and stores the treatment liquid L in the treatment liquid tank 30 (S36). Then, the main control 101 repeats the process starting from S01.

As such, in the treatment-liquid application device 2 according to this embodiment, the intermittent rotation driving is executed such that the phases before and after the regular rotation of the squeeze roller 18 are different from each other, in a state in which the squeeze roller 18 is not in contact with the application roller 14 and the transfer roller 11 does not contact the roll sheet S with the application roller 14 (see S23 of FIG. 4B). That is, when the application operation is not executed, the squeeze roller 18 is rotated at regular intervals and the phase when the squeeze roller 18 stops is made to be different from the phase before the squeeze roller 18 is driven. Such a configuration prevents formation of a space formed between the squeeze roller 18 and each of the application roller 14 and the blade 19 at a certain position of the surface of the squeeze roller 18, thus preventing the squeeze roller 18 from contacting the treatment liquid L of which the viscosity has increased. Thus, contact points of the squeeze roller 18 with the application roller 14 and the blade 19 can be dispersed and corrosion of the squeeze roller 18 can be prevented. As a result, deterioration of the squeeze roller 18 can be prevented.

Such a configuration prevents a dent to be formed in the surface of the squeeze roller 18 due to the corrosion of the squeeze roller 18 by the treatment liquid L, thus preventing uneven application of the treatment liquid L for the application roller 14 which may be caused by the dent. Thus, even when the squeeze roller 18 is used for a long time without replacement, uneven application of the treatment liquid L does not occur. Therefore, according to this embodiment, the treatment-liquid application device 2 is provided that can execute an appropriate process on the roll sheet S, and an image forming system can be provided that can perform the appropriate process and obtain a high quality image.

In addition to a state in which the treatment liquid L is not supplied to the supply chamber 17, in a state in which the treatment liquid L is supplied to the supply chamber 17, the intermittent rotation driving of the squeeze roller 18 is executed at regular intervals (S09 and S34 of FIGS. 4A and 4B). For this reason, in a state in which the treatment liquid L is supplied to the supply chamber 17, the treatment liquid L in which evaporation of volatile components is small is circulated in the squeeze roller 18, condensing of corrosion components according to the evaporation of the volatile components of the treatment liquid L can be alleviated, and the corrosion of the treatment liquid L can be prevented. In a state in which the treatment liquid L is not supplied to the supply chamber 17, the contact with the treatment liquid L at a certain position of the surface of the squeeze roller 18 can be prevented as described above.

At this time, when the number of times of intermittently driving the squeeze roller 18, that is, the number of times of intermittent driving is an odd number in a state in which the treatment liquid L is not supplied to the supply chamber 17, the intermittent rotation driving of the squeeze roller 18 is executed in a state in which the treatment liquid L is not supplied to the supply chamber 17 (S23 of FIG. 4B). When the number of times of intermittent driving is an even number, the intermittent rotation driving of the squeeze roller 18 is executed after the treatment liquid L is supplied to the supply chamber 17 (S34 of FIG. 4B). Even when the application operation is not executed, such a configuration prevents the corrosion of the treatment liquid L which may be caused by the intermittent rotation driving of the squeeze roller 18 in a state in which the treatment liquid L is supplied to the supply chamber 17. Accordingly, such a configuration prevents the squeeze roller 18 from contacting the treatment liquid L at a certain position of the surface of the squeeze roller 18 in a state in which the treatment liquid L is not supplied to the supply chamber 17.

In the state in which the treatment liquid L is supplied to the supply chamber 17, after the intermittent rotation driving of the squeeze roller 18 is executed, the treatment liquid L supplied to the supply chamber 17 is evacuated to and stored in the treatment liquid tank 30 (S12 and S36 of FIGS. 4A and 4B). Such a configuration prevents evaporation of volatile components of the treatment liquid L by maintaining a state in which the treatment liquid L is supplied to the supply chamber 17, thus preventing condensing of corrosion components of the treatment liquid L.

In addition, a pressure-contact mode (refer to S09 of FIG. 4A) and an evacuation mode (refer to S23 of FIG. 4B) are provided. In the pressure-contact mode, the squeeze roller 18 is intermittently rotated while forming a nipping portion between the squeeze roller 18 and the application roller 14 in a state in which the treatment liquid L is supplied to the supply chamber 17. In the evacuation mode, the squeeze roller 18 is retreated from the application roller 14 and intermittently rotated in a state in which the treatment liquid L is not supplied to the supply chamber 17. Thus, the pressure-contact mode in which the treatment liquid L is supplied to the supply chamber 17 can prevent an excess flow amount of the treatment liquid from remaining on the surface of the squeeze roller 18 at the nipping portion of the squeeze roller 18 and the application roller 14. Meanwhile, the evacuation mode in which the treatment liquid L is not supplied to the supply chamber 17 can prevent an increase in viscosity due to a temperature increase of the treatment liquid L which may be caused by rotating the squeeze roller 18 with the application roller 14 nipped by the squeeze roller 18. Thus, corrosion of the squeeze roller 18 can be prevented more reliably.

The circumferential speed when the intermittent rotation driving of the squeeze roller 18 is executed is set to a speed equal to or lower than a minimum application speed or an optimum application speed of the treatment-liquid application device 2, thus suppressing frictional heat of the application roller 14, the blade 19, and the treatment liquid L generated by rotation of the squeeze roller 18. Such a configuration can suppress an increase in viscosity of the treatment liquid L due to the frictional heat and condensing of the corrosion components of the treatment liquid L. As a result, corrosion of the squeeze roller 18 can be prevented more reliably.

In addition, the squeeze roller 18 is configured using stainless steel, preferably, austenite, for example, SUS303 as the base material, so that the squeeze roller 18 has preferable corrosion resistance, and corrosion of the squeeze roller 18 can be prevented more reliably. Particularly, SUS303 has preferable versatility and workability and can reduce manufacturing cost. In addition, the arithmetic average roughness (Ra) of the surface of the squeeze roller 18 is set to be less than 6.4 μm to obtain a smooth surface of the squeeze roller 18. Such a configuration can suppress the liquid accumulation of the treatment liquid L in an uneven portion of the surface of the squeeze roller 18, thus more reliably preventing corrosion of the squeeze roller 18.

As described above, for the image forming system 1000 including the treatment-liquid application device 2 according to this embodiment, the supply roller can be prevented from contacting the liquid at a certain position of the supply roller in the liquid application device that replenishes the liquid by the rotating roller and applies the liquid to the target.

In the above-described embodiments, the case in which the intermittent rotation driving of the squeeze roller 18 is executed is described for each of when the treatment liquid L is supplied to the supply chamber 17 and when the treatment liquid L is not supplied to the supply chamber 17. However, this is one example and a point of this embodiment is that when the treatment liquid L is not supplied to the supply chamber 17, the intermittent rotation driving of the squeeze roller 18 is performed in a retreat state in which the squeeze roller 18 does not form a nipping portion with the application roller 14, i.e., is not in contact with the application roller 14. Accordingly, for example, the processes of S07 to S13, S21, and S31 to S36 of FIGS. 4A and 4B may be omitted and the intermittent rotation driving of the squeeze roller 18 may be executed only when the treatment liquid L is not supplied to the supply chamber 17.

In addition, in the above-described embodiments, the example is described in which after the intermittent rotation driving of the squeeze roller 18 is executed in a state in which the treatment liquid L is supplied to the supply chamber 17, the treatment liquid L supplied to the supply chamber 17 is evacuated to and stored in the treatment liquid tank 30. However, this is one example. For example, if condensing of the corrosion components of the treatment liquid L is unlikely to be caused by evaporation of volatile components of the treatment liquid L in a state in which the treatment liquid L is supplied to the supply chamber 17, the processes of S12 and S36 of FIGS. 4A and 4B may be omitted.

In addition, the above-described embodiments are described assuming that the treatment liquid L is applied to the roll sheet S. However, this is one example. When liquid is supplied by a rotating roller and the liquid is applied to a target, a similar problem may occur even in a target other than the roll sheet S. Therefore, the problem can be resolved by applying the above-described embodiments.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid application device, comprising:

an application roller to apply a liquid to a target;

a container to store the liquid;

a supply roller to rotate with the application roller, the supply roller being immersed in the liquid in the container and supply the liquid to the application roller;

a transfer unit to contact the target with the application roller and cause the application roller to apply the liquid to the target; and a controller to control an operation of the liquid application device, wherein, in a state in which the transfer unit does not contact the target with the application roller, the controller controls the supply roller to rotate and stop at a position different from a pre-rotation position of the supply roller.

2. The liquid application device according to claim 1, wherein, when a threshold time passes in the state in which the transfer unit does not contact the target with the application roller, the controller controls the supply roller to rotate and stop at the position different from the pre-rotation position.

3. The liquid application device according to claim 1, further comprising a liquid feed-and-discharge unit to supply the liquid to the container and discharge the liquid from the container, wherein, in each of a state in which the liquid is supplied to the container by the liquid feed-and-discharge unit and a state in which the liquid is discharged from the container by the liquid feed-and-discharge unit, the controller controls the supply roller to rotate and stop at the position different from the pre-rotation position.

4. The liquid application device according to claim 3, wherein the supply roller is movable from a contact position at which the supply roller contacts the application roller to a separation position at which the supply roller is separated from the application roller, and the controller controls the supply roller to rotate at the contact position in the state in which the liquid is supplied to the container by the liquid feed-and-discharge unit.

5. The liquid application device according to claim 3, wherein the supply roller is movable from a contact position at which the supply roller contacts the application roller to a separation position at which the supply roller is separated from the application roller, and the controller controls the supply roller to rotate at the separation position in the state in which the liquid is discharged from the container by the liquid feed-and-discharge unit.

6. An image forming system, comprising:

an image forming apparatus to eject a color material to a target to form an image on the target; and a liquid application device to apply a liquid to the target before the image forming apparatus forms the image on the target, the liquid application device including an application roller to apply the liquid to the target, a container to store the liquid;

a supply roller to rotate with the application roller, the supply roller being immersed in the liquid in the container and supply the liquid to the application roller, a transfer unit to contact the target with the application roller and cause the application roller to apply the liquid to the target, and a controller to control an operation of the liquid application device, wherein, in a state in which the transfer unit does not contact the target with the application roller, the controller controls the supply roller to rotate and stop at a position different from a pre-rotation position of the supply roller.

7. A method of controlling a liquid application device that includes an application roller to apply a liquid to a target, the method comprising:

rotating a supply roller immersed in a container storing the liquid, in a state in which the application roller is not in contact with the target; and rotating and stopping the supply roller at a position different from a pre-rotation position.

* * * * *